US010017944B2

(12) United States Patent
Boettcher

(10) Patent No.: US 10,017,944 B2
(45) Date of Patent: Jul. 10, 2018

(54) COVER APPARATUS WITH CONTINUING COVER PLATES

(71) Applicant: Maximilian Boettcher, Friesenheim (DE)

(72) Inventor: Maximilian Boettcher, Friesenheim (DE)

( * ) Notice: Subject to any disclaimer, the term of this patent is extended or adjusted under 35 U.S.C. 154(b) by 0 days.

(21) Appl. No.: 15/501,747

(22) PCT Filed: Aug. 3, 2015

(86) PCT No.: PCT/EP2015/001591
§ 371 (c)(1),
(2) Date: Feb. 3, 2017

(87) PCT Pub. No.: WO2016/020051
PCT Pub. Date: Feb. 11, 2016

(65) Prior Publication Data

US 2017/0226740 A1 Aug. 10, 2017

(30) Foreign Application Priority Data

Aug. 6, 2014 (DE) ..... 20 2014 006 376 U

(51) Int. Cl.
*E04D 13/04* (2006.01)
*E04D 13/064* (2006.01)
*E04D 13/08* (2006.01)
*E04F 15/02* (2006.01)
(Continued)

(52) U.S. Cl.
CPC ..... *E04D 13/0409* (2013.01); *E04D 3/361* (2013.01); *E04D 3/366* (2013.01);
(Continued)

(58) Field of Classification Search
CPC ..... E04D 13/0409; E04D 13/0459; E04D 13/0477; E04D 13/0445; E04D 13/08; E04D 13/064; E04D 2013/045; E04D 13/1618; E04D 13/1631; E04D 3/366; E04D 3/361; E04F 15/02016; E04F 15/02183; E04F 13/0876; E04F 13/0864; E04F 2201/0153; E04F 2201/0138; E04F 2201/0146; E04F 2201/013; E04F 2203/04
(Continued)

(56) References Cited

U.S. PATENT DOCUMENTS 3,385,182 A * 5/1968 Harvey ..... E01C 9/083 404/35
5,170,605 A * 12/1992 Huddle ..... B60P 3/20 52/588.1
(Continued)

*Primary Examiner* — Joshua J Michener
*Assistant Examiner* — Matthew J Gitlin
(74) *Attorney, Agent, or Firm* — Budzyn IP Law, LLC

(57) ABSTRACT

A cover apparatus (1), comprising cover plates (2) continuing in a position of use in a common plane and in at least one row, is formed in a mutual edge-side contact region (3) through overlapping and in a rainproof manner, such that edges (5) running parallel to each other and spaced apart on each cover plate (2) are designed differently (6), and the top side (7) of the cover plate (2), a continuing web (8) and a rain gutter (9) under said web (8) are arranged on a first edge (5), wherein said rain gutter belongs to the same first edge (5). If necessary, penetrating rain water (12) can be caught in the rain gutter (9) by overlapping edge-side webs (8) in the position of use.

16 Claims, 16 Drawing Sheets

(51) Int. Cl.
*E04D 3/361* (2006.01)
*E04D 3/366* (2006.01)

(52) U.S. Cl.
CPC ..... *E04D 13/0445* (2013.01); *E04D 13/0459* (2013.01); *E04D 13/0477* (2013.01); *E04D 13/064* (2013.01); *E04D 13/08* (2013.01); *E04F 15/02183* (2013.01); *E04D 2013/045* (2013.01)

(58) Field of Classification Search
USPC ..... 52/592.1, 483.1
See application file for complete search history.

(56) References Cited

U.S. PATENT DOCUMENTS 6,199,340 B1 * 3/2001 Davis ..... C08L 23/10 52/100
6,226,950 B1 * 5/2001 Davis ..... C08L 23/10 52/100
7,021,012 B2 * 4/2006 Zeng ..... E04F 15/02161 404/35
7,793,470 B1 * 9/2010 Mathiesen ..... E04F 15/10 404/41
7,849,655 B2 * 12/2010 Chen ..... E04F 13/18 52/177
2004/0055243 A1 * 3/2004 Yeh ..... E04C 2/08 52/592.1
2005/0284058 A1 * 12/2005 Zeng ..... E04F 15/06 52/302.1
2006/0288651 A1 * 12/2006 Zeng ..... E04F 15/06 52/177
2010/0011695 A1 * 1/2010 Cheng ..... E04B 1/6116 52/592.1
2013/0219806 A1 * 8/2013 Carrubba ..... E04F 15/02033 52/58

* cited by examiner

COVER APPARATUS WITH CONTINUING COVER PLATES

The invention relates to a cover apparatus with cover plates in a common plane in a position of use and in at least one row of continuing cover plates which partially overlap in their mutual edge-side contact region.

Such covers are known in many shapes and for various applications. For example, such covers are known as balcony floors or as roofs over balconies or as roofs for car ports and so on.

Therefore, in many cases, it is important that the contact point of two cover plates is rainproof, so that if there is rain or other precipitation, no water may get under the region located into this cover.

In practice, it has been shown that such a rainproofing may not always or not always sufficiently be obtained by a mutual overlapping of edges or parts of edges, particularly if the cover plates sag and/or are deformed due to loads or when somebody walks on them.

There is therefore the task of creating a cover of the type defined in the preamble that is at least largely rainproof even if deformations occur, for example, due to a load or they are manufactured or fitted less precisely.

This task is solved with the means and characteristics of claim 1.

In particular, for solving the task it is provided that the edges running parallel to each other, spaced apart from one respective cover plate to another are formed differently for a mutually rainproof overlap and on a first edge a web continuing the top side of the cover plate and a rain gutter is arranged under this web, one edge of which is connected watertight with the cover plate exhibiting it and is set back against the free edge of the web and the other edge of which is formed as a free edge that loops under an edge-side web of the adjacent cover plate at a gap in a position of use. The rain gutter preferably forms part of the mentioned first edge, but may also be provided on the other edge that is therefore interacting with it in a position of use.

Therefore, if precipitation water or rainwater penetrates into the contact region of two cover plates thus formed, this water gets into the "rain gutter" located under this contact region on the top side and is collected by it, and particularly carried away if this gutter also runs somewhat inclined.

It is advantageous here if, on the second edge of the cover plate, continuing its top side, the edge-side web is provided as an upper free edge that is at least partly located somewhat lower than the top side by the thickness of the web of the adjacent plate located on the first edge, so that in a position of use the web of the first edge of one cover plate loops under this second web of the other edge of the adjacent cover plate or if the web is located lower than the first edge, as the case may be, in such a way that, in a position of use, the web on the second edge loops over the web of the first edge of an adjacent plate.

The mutual looping over or even under of the webs continuing the top sides of the adjacent cover plates in a position of use therefore creates such a gapless continuation that may already be largely watertight, but due to the small unevennesses or contaminations, precipitation water would be able to seep through the gutter located underneath. Therefore, the combination of overlapping webs with the gutter is favourable for the endeavoured rainproofing.

In so doing, for as little as possible rain permeability, it is advantageous if the edge-side webs close to the surface of at least two such cover plates continuing in a position of use, touch two-dimensionally or one-dimensionally at least in some regions.

A further improvement of rainproofing, particularly even in the event of heavy rain, may be achieved if in the contact region of both edges of two cover plates a second collecting gutter for rainwater located lower is provided, which is particularly provided on that edge of the cover plate that runs parallel to the edge with the first rain gutter and with a gap. This means that both parallel edges spaced apart may exhibit one of the rain gutters that may collect rainwater seeping through the upper contact of the edge-side web in a position of use, wherein the second rain gutter, located lower in a position of use, can accept the water that overflows the upper rain gutter.

A quite particularly advantageous embodiment of the invention with regard to the mutual contact and fastening of two cover plates may consist of providing a cover plate in a position of use on the edges formed parallel facing away from each other, mutually spaced and differently formed of a cover plate, and therefore a clipping connection on the edges touching in a position of use of two such cover plates. The cover plates hold their position within the cover apparatus correspondingly well, even if the clipping connection has a push fit, and therefore allows a mutual displacement against friction.

It is therefore favourable if the edges facing towards each other and touching in a position of use of two continuing cover plates protrude with a gap under the top side of clipping webs facing towards each other—against the edges with their cross-sections, that overlap and touch in a clipping way in a position of use. In so doing, not only can the mutual connection be improved but the cover plates mutually touching in the edge region are also reinforced.

The gap from the free edge of the web running above the first rain gutter from the free edge of this rain gutter may be of such a size that the web protruding in the region of the top side of the other edge, of an adjacent cover plate may be able to be inserted at least inclined into this gap and intermediate space and may be able to pivoted into the position of use. In so doing, the mutual fitting of continuing cover plates to put together a cover apparatus is simplified, as the cover plates to be brought into the mutual contact position do not have to be mutually aligned to be able to be put together. Therefore, in spite of the rain gutter arranged under the top side webs, they can be joined together and brought into a mutually aligned position.

It may be instrumental for a space-saving and nevertheless secure connection of cover plates to form a cover apparatus if, before connecting the at least two cover plates continuing in a position of use, the internal gap between the web arranged above the first rain gutter, ending free and the relevant clipping web located lower opposite the top side of the same edge of the cover plate is less than the external gap between the upper web overlapping in a position of use and the second clipping web on the second edge of the adjacent cover plate, and if the web ending clear first mentioned and the clipping web located on the same edge in a position of use accept the counter-webs of the adjacent cover plate so that they clip in their intermediate space.

This arrangement allows the mutual clipping connection of continuing cover plates mutually aligned and nevertheless the joining together in such a way that one cover plate is initially inserted inclined with its upper web into the intermediate space between the upper web of the adjacent plate and the free edge of the upper rain gutter and then pivoted into its position of use wherein the clipping webs come together and finally mutually loop behind so that they clip. Therefore, the desired clipping connection is enabled, but without having to fit together the plates already in a mutually aligned position, which would need correspondingly more installation space.

At least one of the clipping webs or both clipping webs touching in a position of use of the interconnected, continuing cover plates may have a bent cross-section arranged adjacent to the clipping point, wherein the bend of one clipping web faces away from the other clipping web in a position of use. This makes the mutual pushing together at the last moment of pivoting of one cover plate into the other and into the position of use easier, as the bent edges favour gradual putting together, wherein instead of a bend, one or more tapers may also be provided. In so doing, the bent edge or edges of the clipping webs may have the same effect as runners on the respective counter-clipping web and slide mutually into their final position of use.

The free ending webs both overlapping each other in a position of use at least on the top side of the cover apparatus and accordingly the clipping webs opposite located lower, may be able to be pushed relative to each other in the orientation direction of the cover plates transverse to the edges to be connected and the pushing path may be delimited by at least one stop. Due to this ability of the cover plates to be pushed mutually with rainproofing nevertheless remaining the same, imprecisions when fitting and/or thermal expansions may be absorbed or compensated for.

In so doing, it may be advantageous if the stop delimiting the pushing path of the touching cover plates is a lower boundary limit of one cover plate and the lower boundary limit of the adjacent cover plate which is therefore preferably flush in a position of use. If the cover plates are therefore pushed together until they stop, the bottom side is practically visibly closed.

The counter-stop to delimit the pushing path of both cover plates interacting and connected in a position of use may be a delimitation of the second collecting gutter. Therefore, this collecting gutter arranged lower compared with the top side in a position of use, is located as close as possible to the adjacent cover plate and comes into contact with this when the cover plates are pushed together with their delimitation.

The lower second collecting gutter may be subdivided by a web located high in a position of use and/or separated by its fastening side and the free part of this collecting gutter close to the edge may be provided to accept water that overruns the partition wall. Therefore, if rainwater seeps over the upper rain gutter into the lower region of the lower gutter, this rainwater may initially pool in the mentioned upper web, but then also penetrate into the part of this collecting gutter close to the edge, if the quantity of water overruns the mentioned web.

With suitable dimensions relating to the arrangement of the second collecting gutter located lower in a position of use and the clipping webs according to claim 14, the already mentioned closed-off bottom side of the entire cover apparatus may be advantaged.

Further embodiments of the cover apparatus according to the invention can be found herein.

Characteristics can be found herein by which the cover plates and therefore also the cover apparatus are given such a thickness and stiffness that they can be at least mutually supporting or even self-supporting. Therefore, in the majority of cases, for the cover apparatus according to the invention, no substructure is required and it may be linked statically to its application point.

Dimensional ratios can be found herein relating to an advantageous, mutual overlapping of the cross-sections of the cover plates touching the upper webs and benefits the rainproofing and mutual stabilisation.

The reinforcement webs arranged between an upper and a lower plane or layer of a respective cover plate, may run parallel to the edges of the cover plates touching in a position of use and overlapping in regions. The reinforcement thus achieved is correspondingly effective.

Furthermore, by arranging the reinforcement webs mutually parallel and against the edges touching in a position of use, it is possible that the cover plates are made of aluminium or an aluminium alloy and/or of polymer and are particularly extrusion-pressed. In so doing, in practice, virtually any longitudinal expansions in the direction of the touching edges and these reinforcement webs are enabled.

The cover plates are advantageously formed rectangular, according to the invention, and their four delimitations therefore form a rectangle, wherein the edges overlapping rainproof in a position of use are advantageously the longer edges, therefore the longitudinal edges of this rectangle.

This, too, is particularly favoured by an extrusion press manufacturing process. Furthermore, cover plates result which have large longitudinal expansions, and can therefore, for example, form the surface of a balcony or its upper roof, wherein then only such cover plates extending to the wall of the building touch edge-side, while the abutting ends may, at the same time, form the ends of this balcony roof.

The length of the longitudinal edges of the cover plates may therefore be a few or many times the length of the transverse edges arranged at a right angle.

Particularly when combining individual or several of the characteristics and measures described above, a cover apparatus can be produced that can be fitted as far as possible without supporting structure along its length, is nevertheless rainproof and even remains rainproof if there are movements due to heat or similar, but that at the same time can be easily manufactured and fitted. For example, a sloping roof may be formed from such cover plates, in such a way that a cover plate laid running transverse to this roof is then pivoted into the next lower one and is brought into an alignment position, and so on, until the corresponding cover plates cover the entire sloping surface as the roof and, due to their rainproofing, protect a space located underneath from rainwater.

Below, illustrative examples of the invention will be described in more detail using the drawing. Partly in schematic representation:

FIG. 1 shows in illustrative representation, a balcony with a roof, a balcony surface and a terrace, wherein a cover apparatus according to the invention is provided for the roof, for covering the balcony surface and also for the terrace, and thus the cover plates continuing in series respectively forming the cover apparatus are schematically illustrated, FIG. 2 to FIG. 6 show in more or less schematic representation the attachment of a cover plate to a prefitted cover plate, wherein the thus joining edge formations of the cover plates provided respectively on the opposite edges, can be seen in side view or in cross-sectional view, in particular FIG. 2 shows a prelaid cover plate and a second cover plate connected thereto and held initially with its cross-section somewhat vertically close to one edge of the prelaid cover plate, FIG. 3 shows the insertion of the edge of the cover plate to be connected on the other longitudinal edge facing towards the prelaid cover plate, FIG. 4 shows the pivoting of the cover plate to be connected, wherein clipping webs are put into an effective connection on both edges located next to each other, FIG. 5 shows the further swivelling of the cover plate to be attached in its position of use and FIG. 6 shows the final swivelling of the cover plate to be attached, in alignment with the prelaid cover plate, so that the top sides of both cover plates continue and are in a common plane, FIG. 7 shows, at an enlarged scale, both of the mutually facing edges of two joined cover plates, wherein both cover plates still have as great as possible mutual spacing, that can be reduced or increased by pushing together, which is delimited by an upper stop in an upper rain gutter in its greatest possible extension, and FIG. 8 shows a representation according to FIG. 7, according to which both cover plates are pushed together to reduce or to remove their mutual edge gap, FIG. 9 to FIG. 14 show a representation of a modified embodiment of the joining of two cover plates corresponding to FIG. 2 to FIG. 6, in which both plates have a larger overall thickness and the upper rain gutter is formed larger in the position in use, FIG. 9 shows a prelaid cover plate and a second cover plate arranged somewhat at a right angle to it, shortly before it is joined to the cover plate first mentioned, FIG. 10 shows the cover plate to be joined in a first contact with the prelaid cover plate, wherein the cross-sections of both cover plates are arranged mutually somewhat at a right angle.

Figure 13:
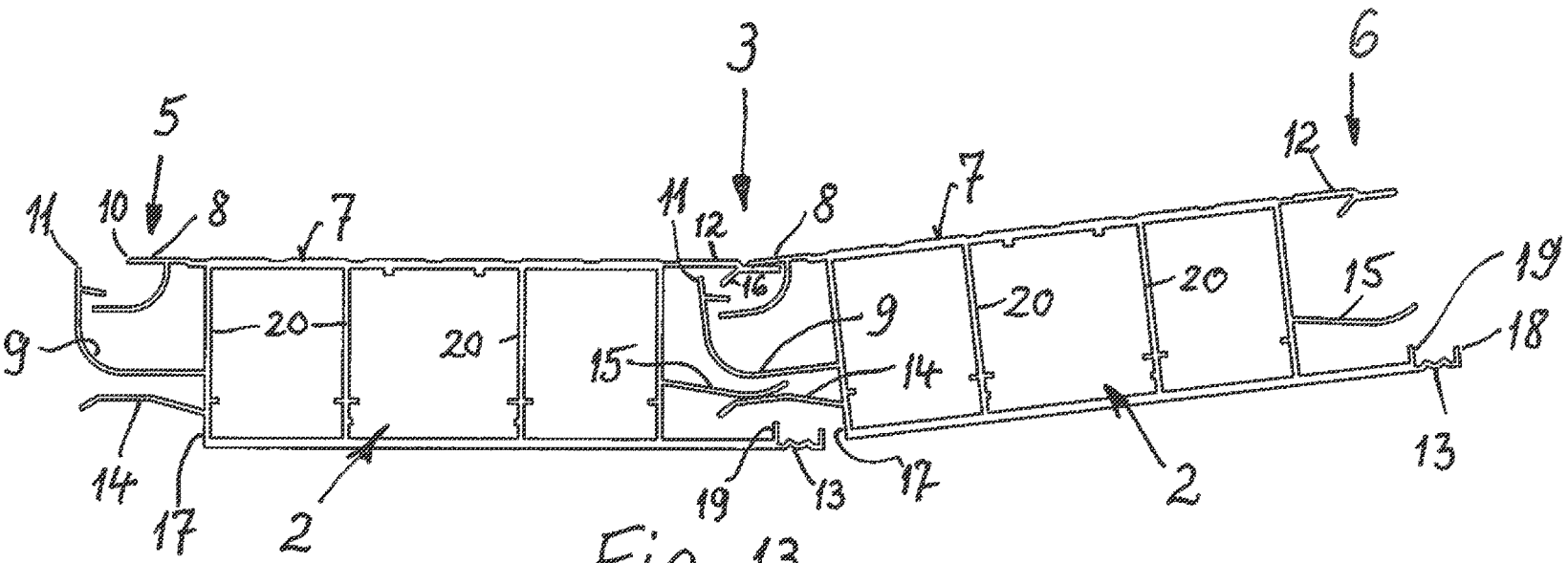
Figure 14:
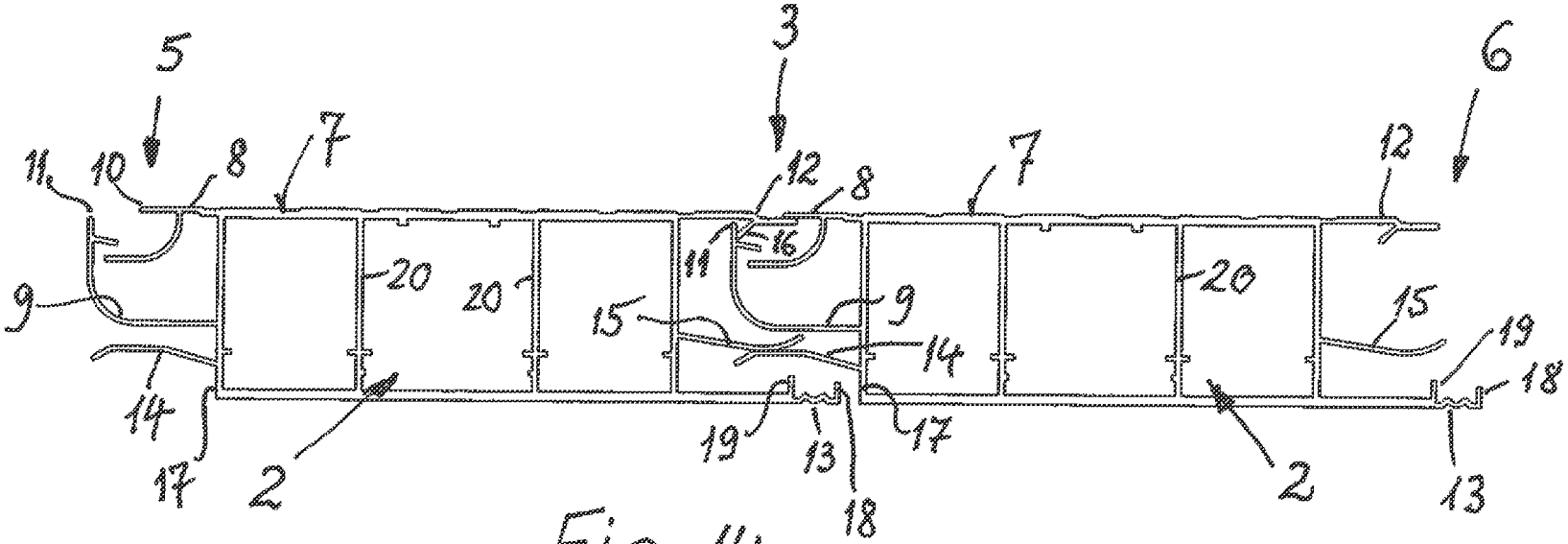
Figure 15:
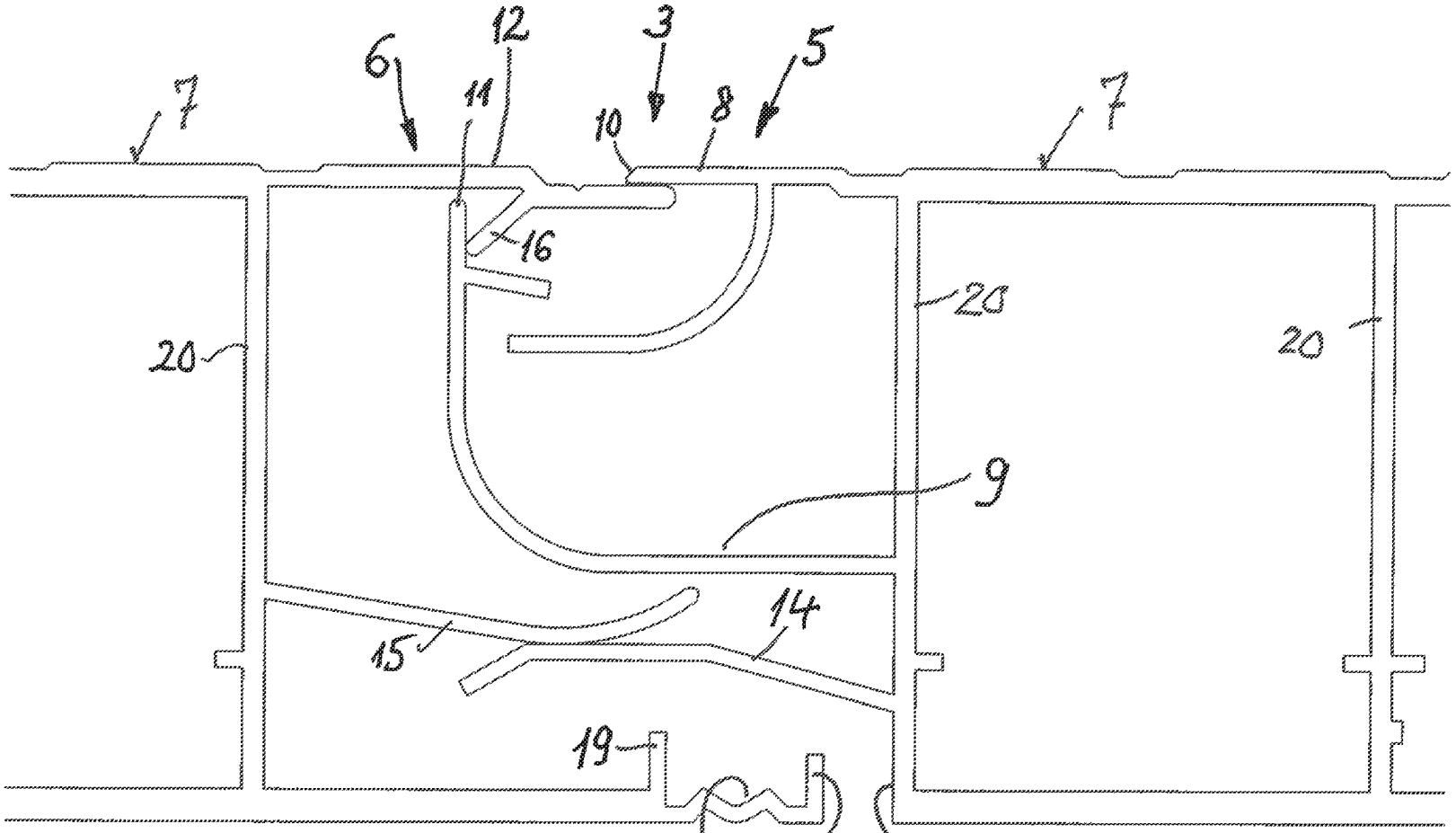
Figure 16:
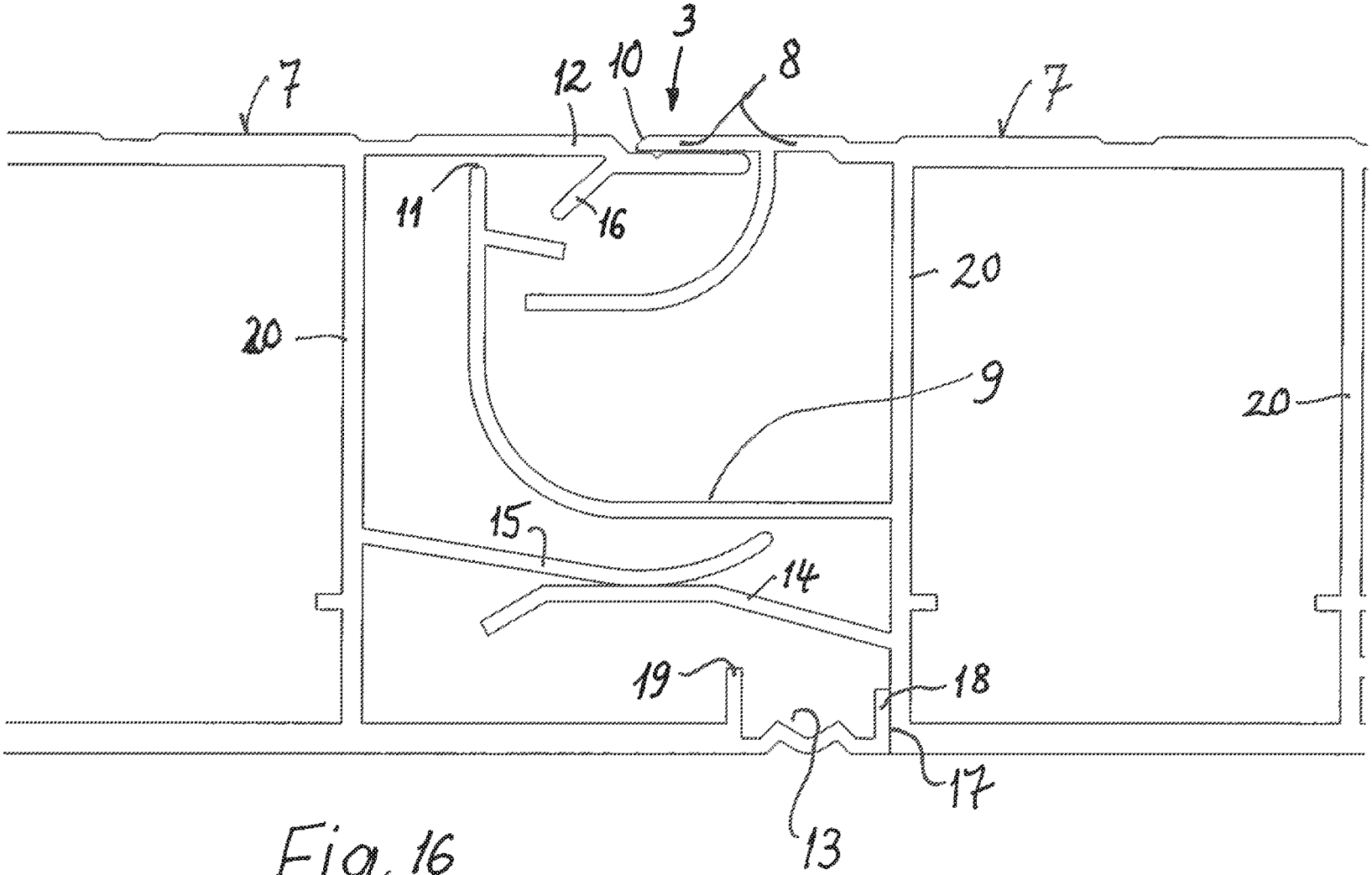

FIG. 13 shows a swivelling of the cover plate to be attached virtually in the position of use and FIG. 14 shows the finally swivelled position of the cover plate to be attached, in such a way that both cover plates and, in particular, their top sides are mutually aligned and are arranged in a common plane, FIG. 15 shows an enlarged illustration of both edges of the continuing cover plates located next to each other in the position of use, wherein they have the greatest possible gap for the movement of pushing mutually together, and FIG. 16 shows the position of both edges of the connected cover plates facing towards each other to mutually push to a stop so that the bottom side of the cover plates is closed.

In the following description of the various illustrative examples, with respect to their function, corresponding parts also have corresponding reference numbers even in the differing embodiment.

Figure 1:
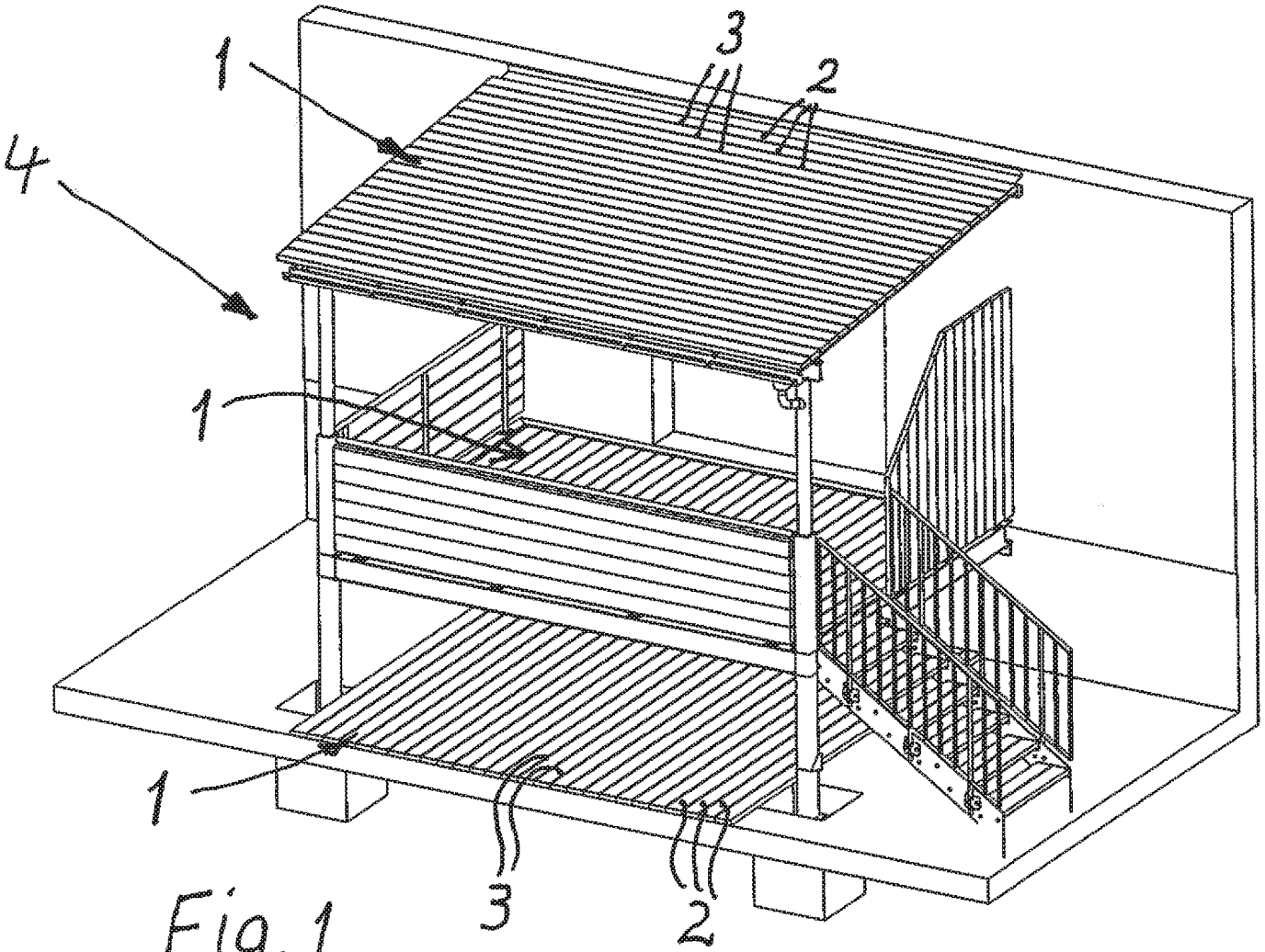
Figure 2:
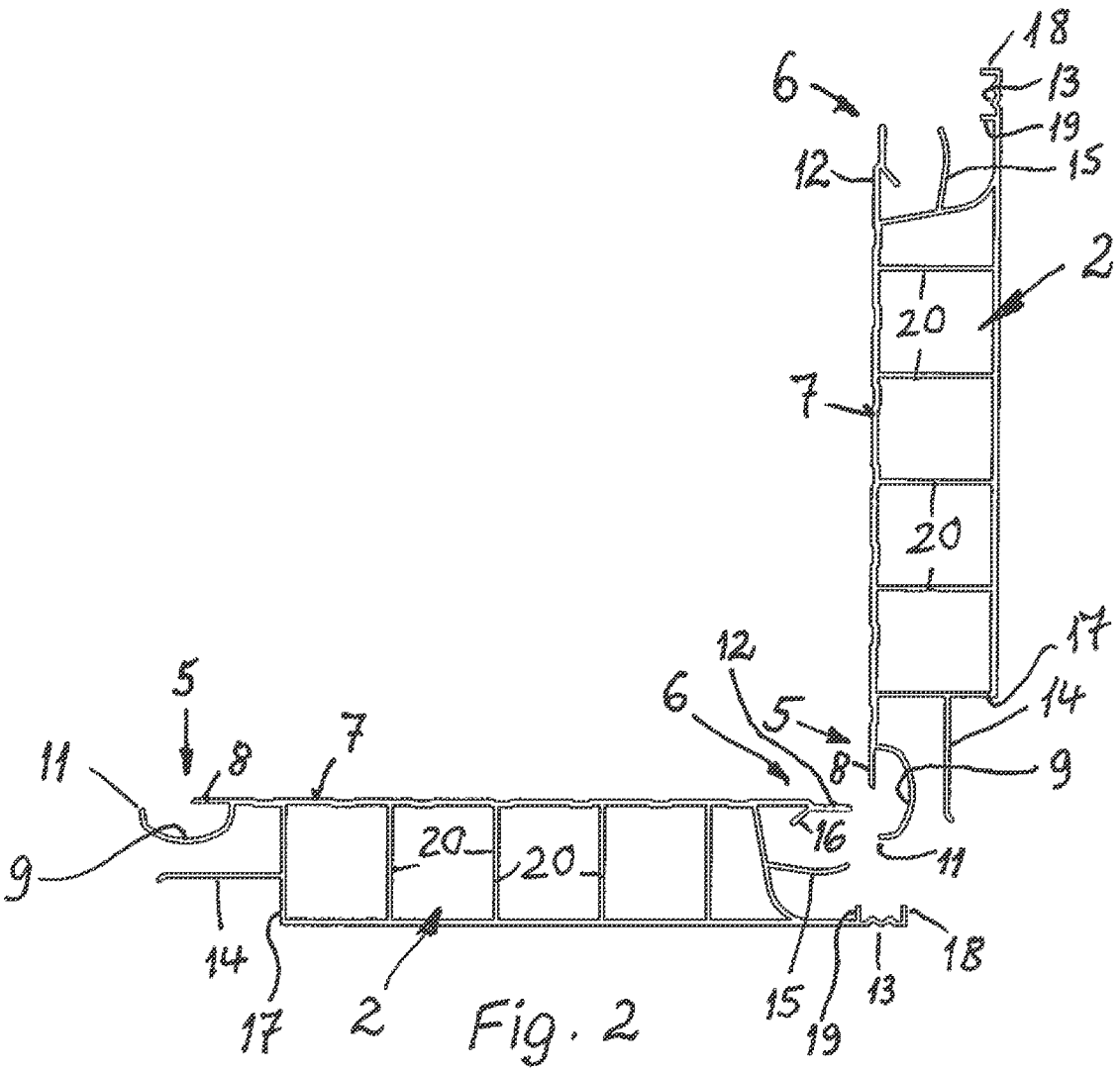

A cover apparatus designated as a whole 1 comprises cover plates 2 in a common plane in a position of use according to FIG. 1 and at least one row of continuing cover plates 2 which partially overlap in their mutual edge-side contact region 3. On a balcony designated as a whole with 4, three different applications of such a cover apparatus 1 are shown as examples. Therefore, the roof, the balcony surface or even the terrace located under the balcony surface may respectively exhibit such a cover apparatus 1, wherein the roof of a car port or another application is also conceivable.

Using FIG. 2 to FIG. 8 on the one hand and using FIG. 9 to FIG. 16 on the other, it is shown how the cover plates 2 get into their mutual position of use and how it is achieved that the edge-side contact regions 3 overlap in such a way that the rainproofing is achieved at these contact regions 3.

In both illustrative examples, it is provided that edges 5 and 6 spaced apart that run mutually parallel on a respective cover plate 2 are formed differently for a mutual rainproof overlap according to FIG. 6 to FIG. 8 and FIG. 14 to FIG. 16. On a first edge 5 is, therefore, respectively a web 8 continuing the top side 7 of the cover plate 2 and a rain gutter 9 arranged in a position of use under this web 8, said rain gutter forming part of the same first edge 5, one edge of which is connected watertight and forming a single part in the illustrative examples with the cover plate 2 exhibiting it. The opposite free edge 10 of the web 8 is set back against this rain gutter 9 and the other edge 11 of this rain gutter 9 is formed as a free edge which, in the position of use loops under a yet to be described edge-side web 12, close to the surface or continuing it, of the adjacent cover plate 2 with a gap.

On the second edge 6 of the cover plate 2, therefore, in continuation of its top side 7, the edge-side web 12 is provided as an upper free edge. It can be seen from the drawings already mentioned that this edge-side web 12 is laid lower than the top side by a thickness of the web 8 of the adjacent cover plate 2 located on the first edge 5, in such a way that in the position of use according to FIG. 6 to FIG. 8 and FIG. 14 to FIG. 16 already mentioned, the web 8 of the first edge 5 loops over this second web 12 and nevertheless the top sides 7 are aligned. As appropriate, an embodiment in which both webs 8 and 12 are arranged in the reverse order but then overlap would be conceivable.

In this case, the drawings make clear that the edge-side webs 8 and 12 close to the surface come into contact with two cover plates 2 continuing in a position of use, two-dimensionally or one-dimensionally at least in regions, in a position of use, which already produce a certain watertightness against the rain. Through this contact point of webs 8 and 12, however, penetrating rainwater is collected by the rain gutter 9 and may be carried away by this, so that the entire cover apparatus 1 is rainproof.

This rainproofing is further extended and improved in both illustrative examples, in that in the contact region 3 of both edges 5 and 6 of the two cover plates 2 a second lower-lying collecting or rain gutter 13 for rainwater is provided on that edge 6 of the cover plate 2 that runs parallel to the edge 5 with the first rain gutter 9.

For a good mutual fastening in a position of use, in both illustrative examples, on the differently formed edges 5 and 6 of a cover plate 2 and therefore, on the edges 5 and 6 touching in a position of use, a clipping connection of two such cover plates 2 is provided in a position of use. To do this, on the edges 5 and 6 facing towards each other and touching in a position of use, with a gap under the top side 7 and therefore under the webs 8 and 12, clipping webs 14 and 15 facing each other are provided, which overlap in a position of use according to FIG. 6 to FIG. 8 and FIG. 14 to FIG. 16 and touch in such a way that they are clipped.

This clipping effect, which leads to a push fit on the contact points and therefore makes the fitting yet to be described easier, is achieved in the illustrative examples, in such a way that, before connecting the at least two cover plates 2 continuing in a position of use, the internal gap between this web 8 arranged above the first rain gutter 9, ending free and the relevant first clipping web 14 located lower opposite the top side 7 and this web 8 of the same edge 5 of the cover plate 2 is less than the external gap between the overlapped upper web 12 in a position of use and the second clipping web 15 on the second edge 6 of the adjacent cover plate 2, and if the web 8 ending free first mentioned and the first clipping web 14 located on the same edge 5 that in a position of use accepts the counter-webs in their intermediate space and due to the dimensions mentioned therefore deploy the clipping effect mentioned.

In so doing, it can be seen that both clipping webs 14 and 15 have a cross-section bent away from each other, so that their free edges correspond slightly so they can be pushed past each other when fitting together, although this produces the clipping effect already mentioned in the further course of the fitting process.

In FIG. 2 to FIG. 6 and FIG. 9 to FIG. 14, the mutual fitting process for putting together two cover plates 2 continuing in a position of use are shown schematically, but are nevertheless demonstratively illustrated.

Of significance here is that the gap from the free edge of the web 8 running above the first rain gutter 9 is of such dimensions from the free edge 11 of this rain gutter 9 in the orientation direction of both cover plates 2, and is of such a height that in the region of the top side 7 of the other edge 6 of a web 12 protruding from an adjacent cover plate 2 according to FIG. 2 and FIG. 3 and FIGS. 9 and 10 in this gap and intermediate space can be inserted at least inclined and then can be pivoted according to the figures in the position of use. Through this pivoting movement, the clipping webs 14 and 15 then also mutually approach and may slide over each other into the corresponding position of use and, in so doing, the clipping effect already describes is deployed.

Figure 3:
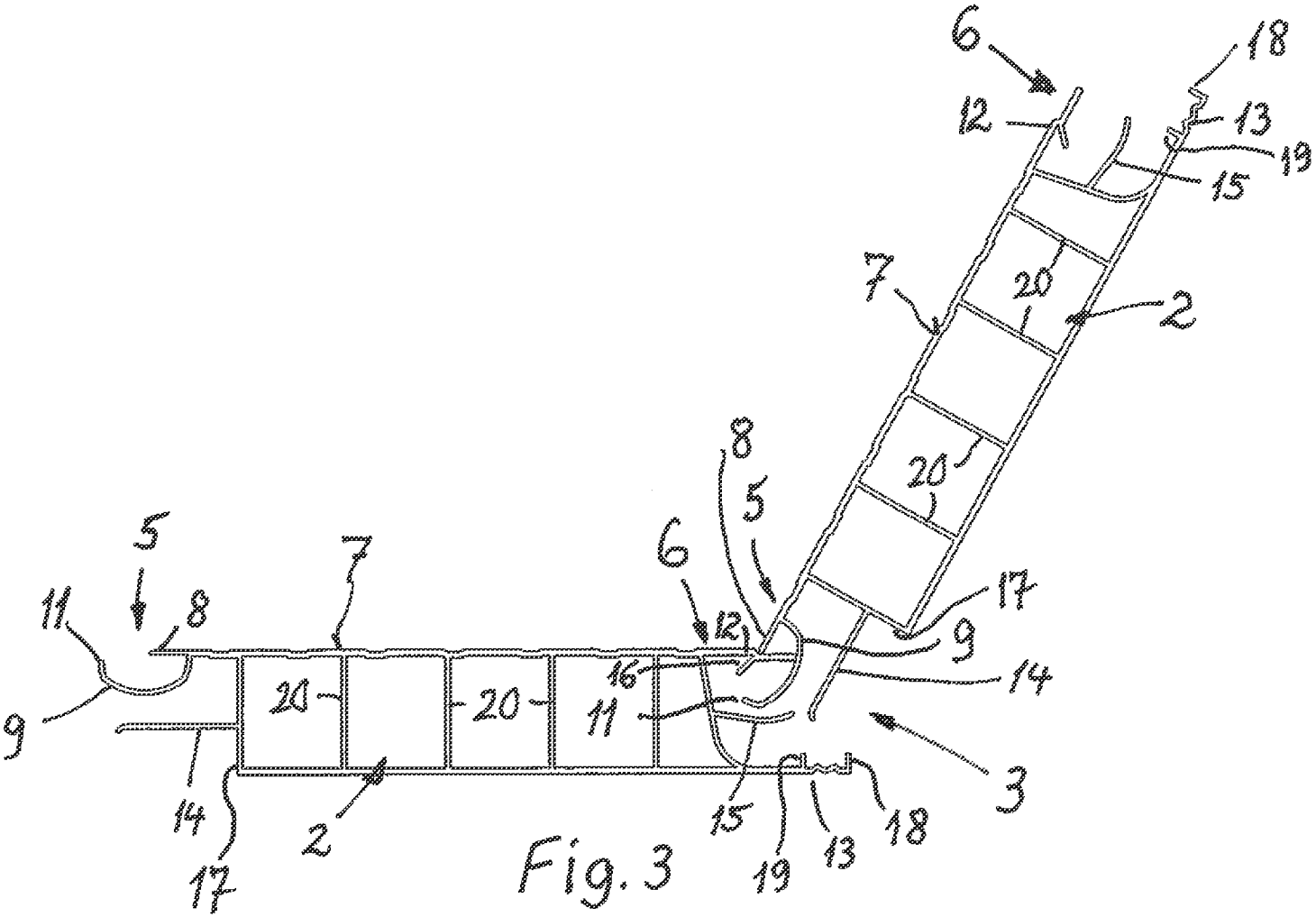
Figure 4:
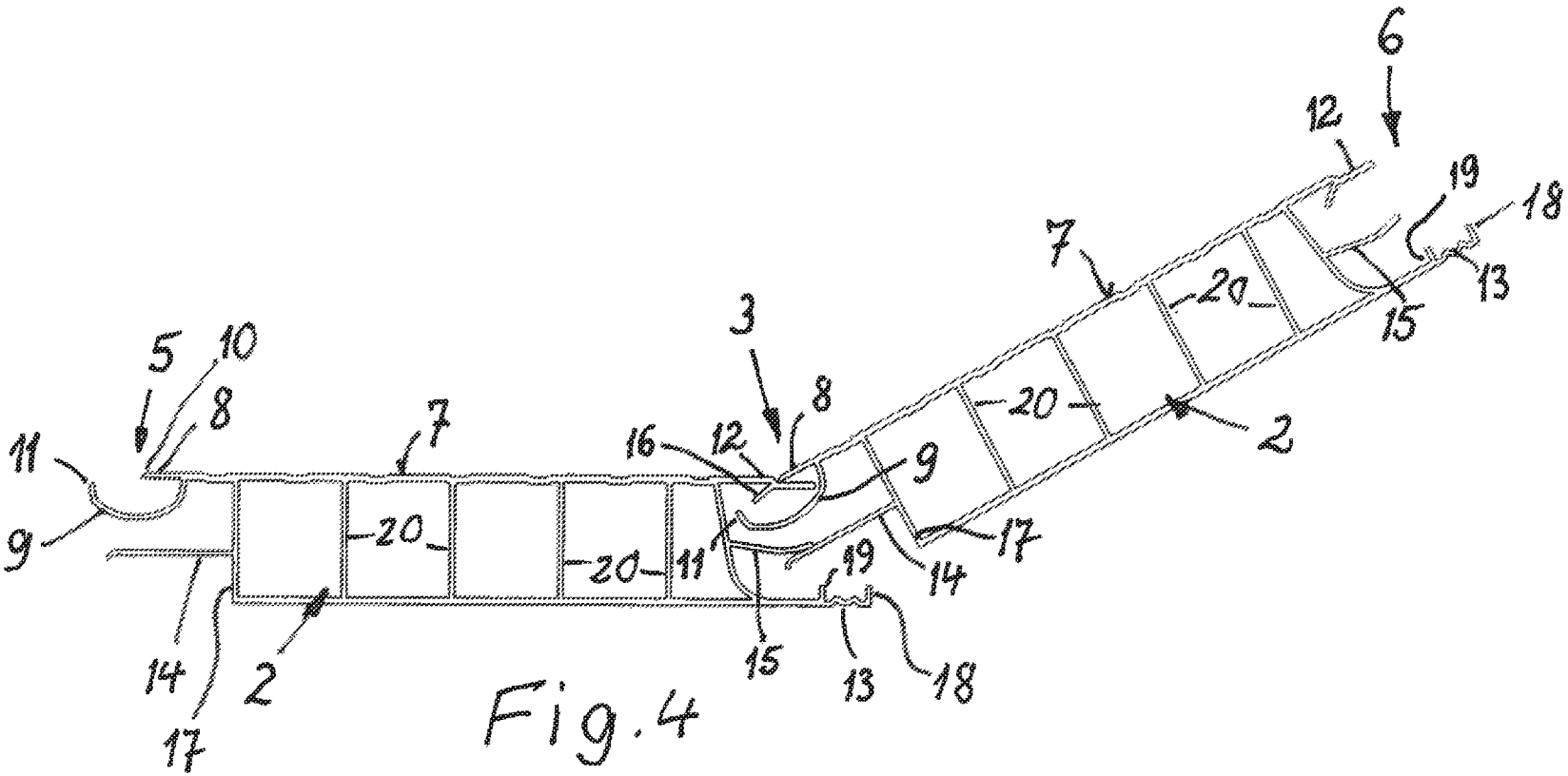
Figure 5:
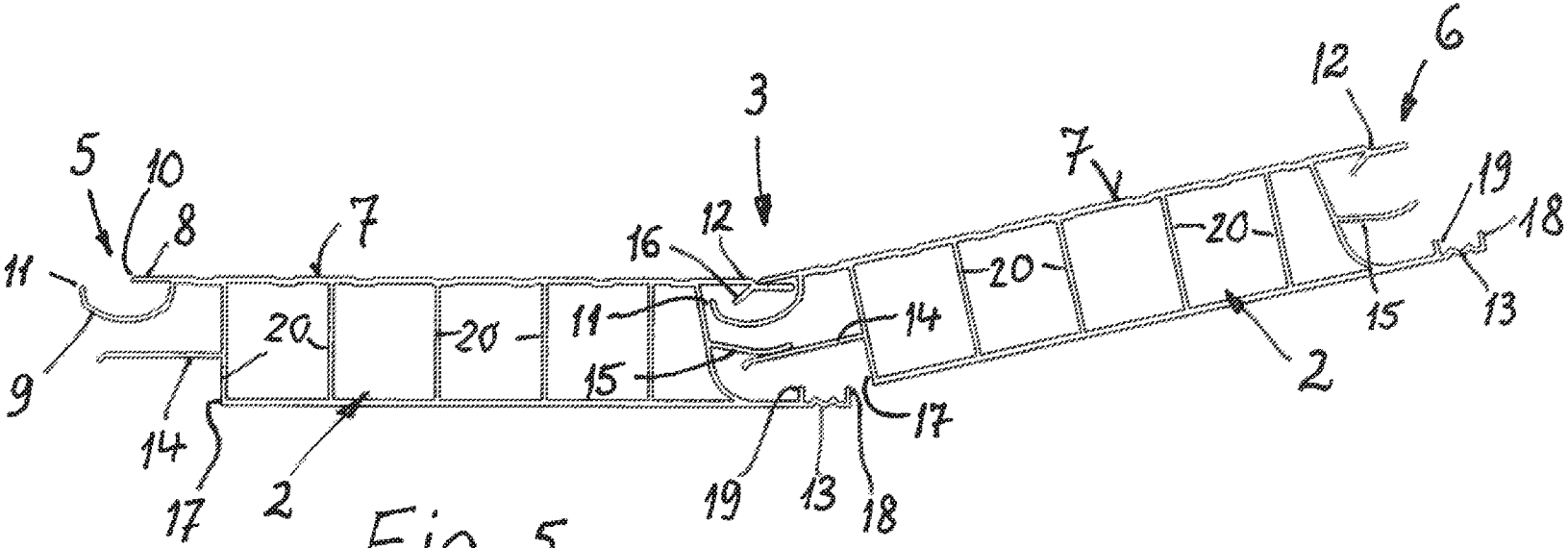
Figure 6:
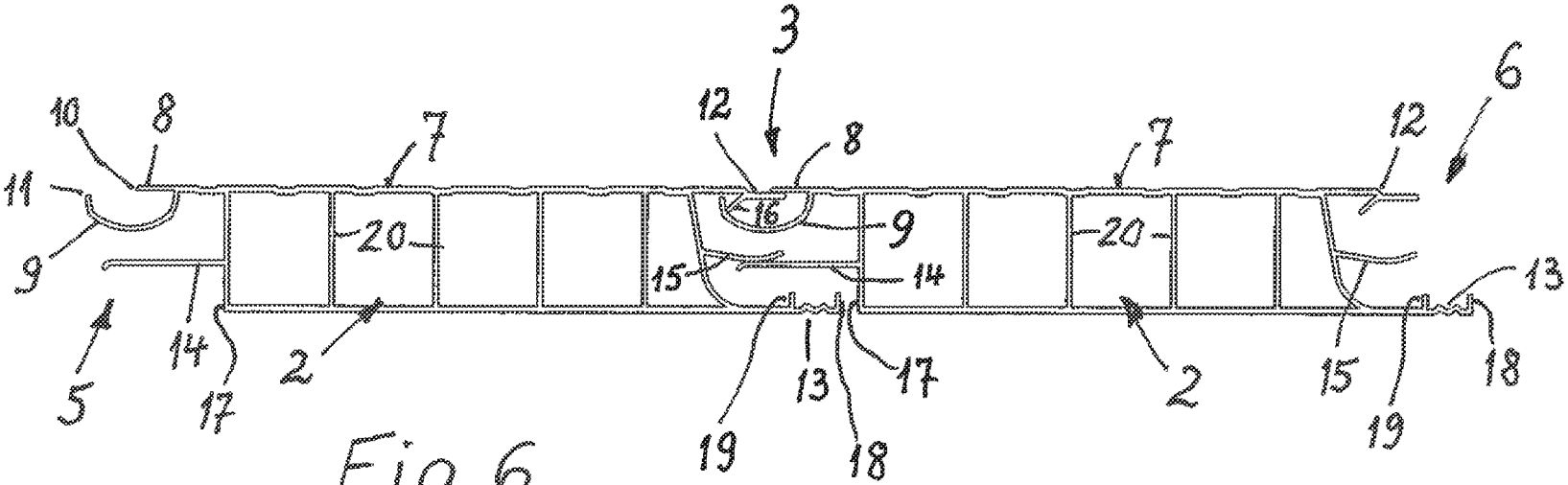
Figure 7:
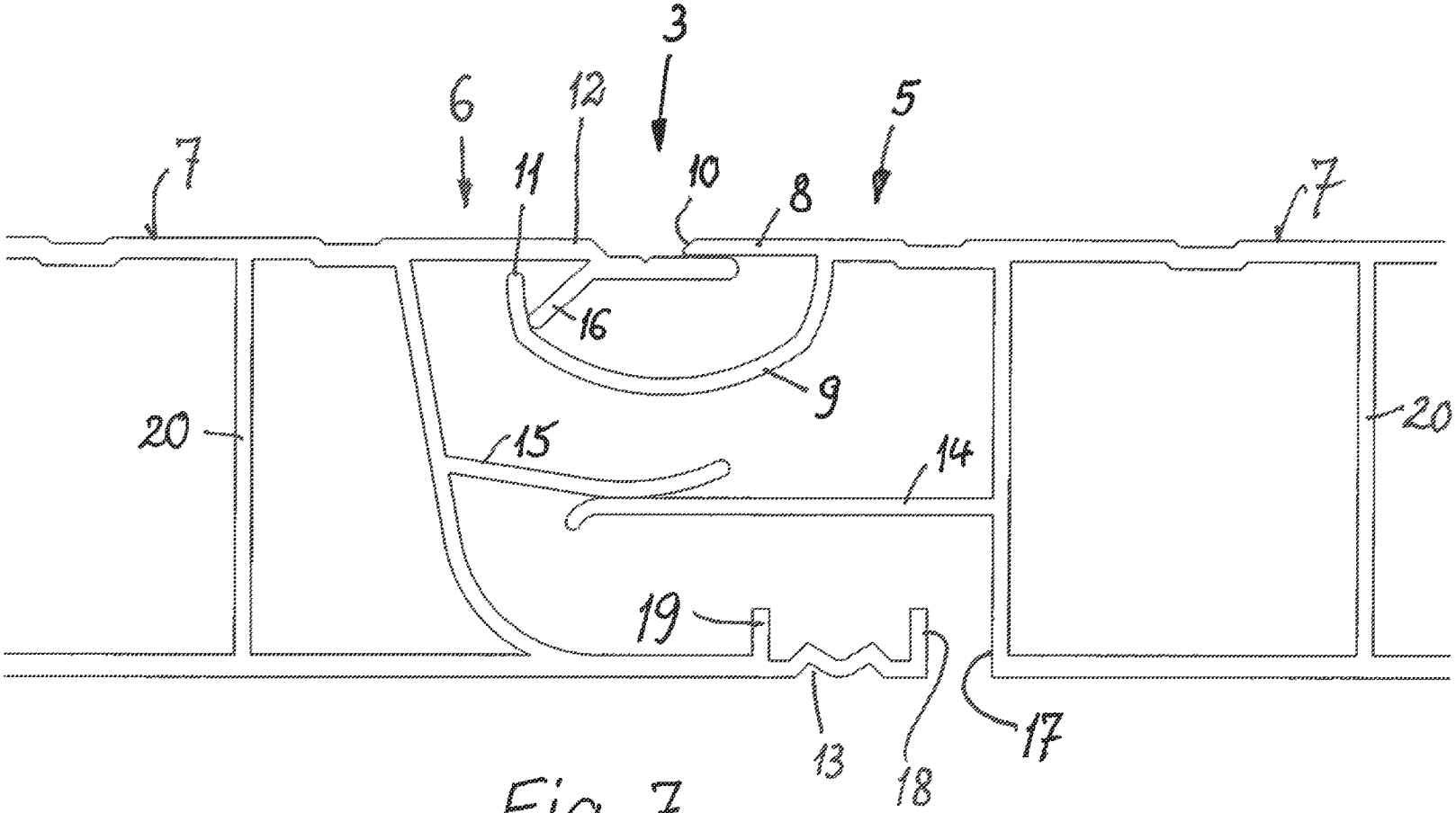
Figure 11:
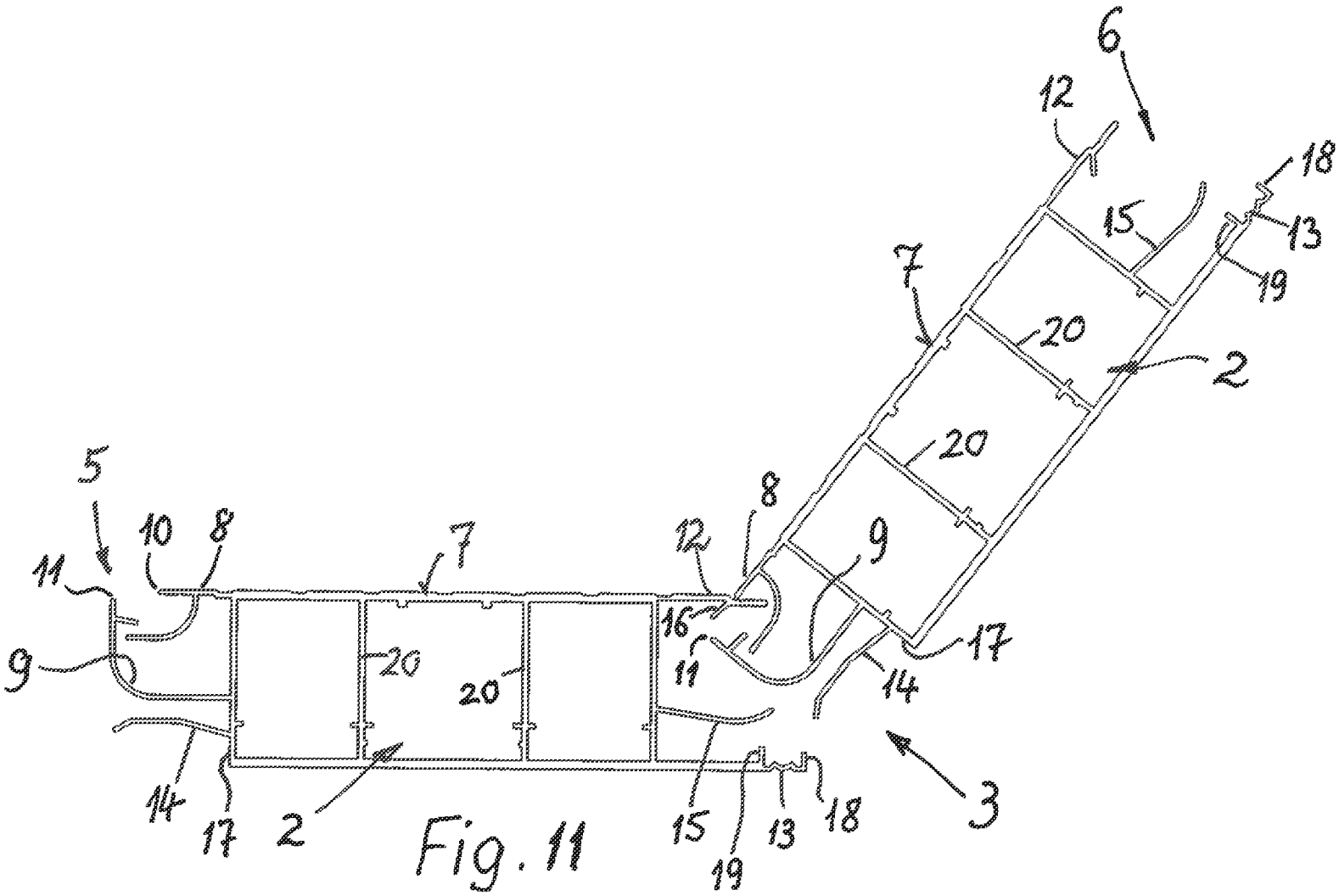
FIG. 11 shows a partial swivelling of the cover plate to be attached.
Figure 12:
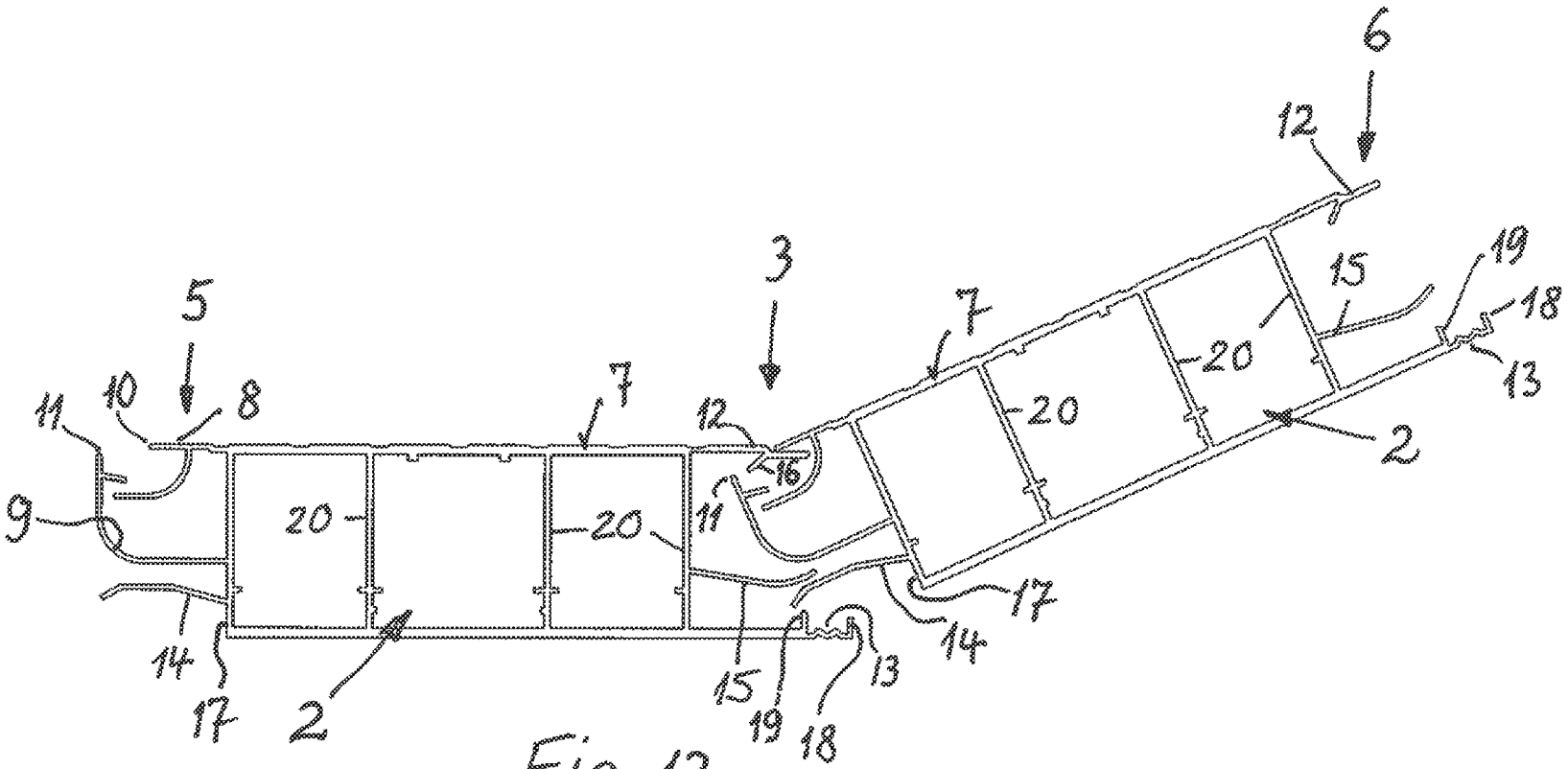
FIG. 12 shows a further swivelling of the cover plate to be attached.

In so doing, according to FIG. 3 and also according to FIG. 11 and FIG. 12, the second web 12 can reach as far as the base of the first rain gutter 9 and can slide into it with the swivelling movement so that wrong positioning occurring is also avoided when putting together both edges 5 and 6, that hinder or prevent the mutual pivoting.

Therefore, both free-ending webs 8 and 12 overlapping each other in a position of use at least on the top side of the cover apparatus 1 and the opposite lower-lying clipping webs 14 and 15 are able to slide relative to each other in the orientation direction of the cover plates 2 initially during the swivelling movement, according to FIG. 7 and FIG. 8 and FIG. 15 and FIG. 16 also in the aligned position relative to each other in the orientation direction of the cover plates 2, wherein the sliding path is delimited by at least one stop. It is just the ability to slide even into the mutually aligning position that allows the absorption of inaccuracies when fitting and/or thermal movements and, as the case may be, slight deformations occurring due to loads.

It should also be mentioned that, for the aligned final position, at least for the position in which both touching cover plates are pushed apart as far as possible, a stop web 16 is provided under the second web 12 said stop web preventing a further sliding of both cover plates 2 away from each other in interaction with the rain gutter 9, in which it can support as far as its base in a position of use.

The stop delimiting the pushing path of the touching cover plates 2 when they are pushed together is a lower edge limitation 17 of the adjacent cover plate 2. The counter-stop for delimiting the pushing path of both cover plates closing onto each other is therefore the limitation 18 of the second lower collecting gutter 13.

The lower second collecting gutter 13 is subdivided by a web 19 standing high in a position of use or partitioned after its fastening side. The free part of this collecting gutter 13 close to the edge is provided to accept any additional water penetrating, which may overrun this separating web 19, in spite of the first rain gutter 9. If water initially penetrates in between both clipping webs 14 and 15 into the second rain gutter 13, this is collected in the left part of the lower edge region in FIG. 7 or 15, until it has been raised high enough that it can flow over the web 19 in order then to be accepted by the actual collecting gutter 13 and carried away.

Figure 8:
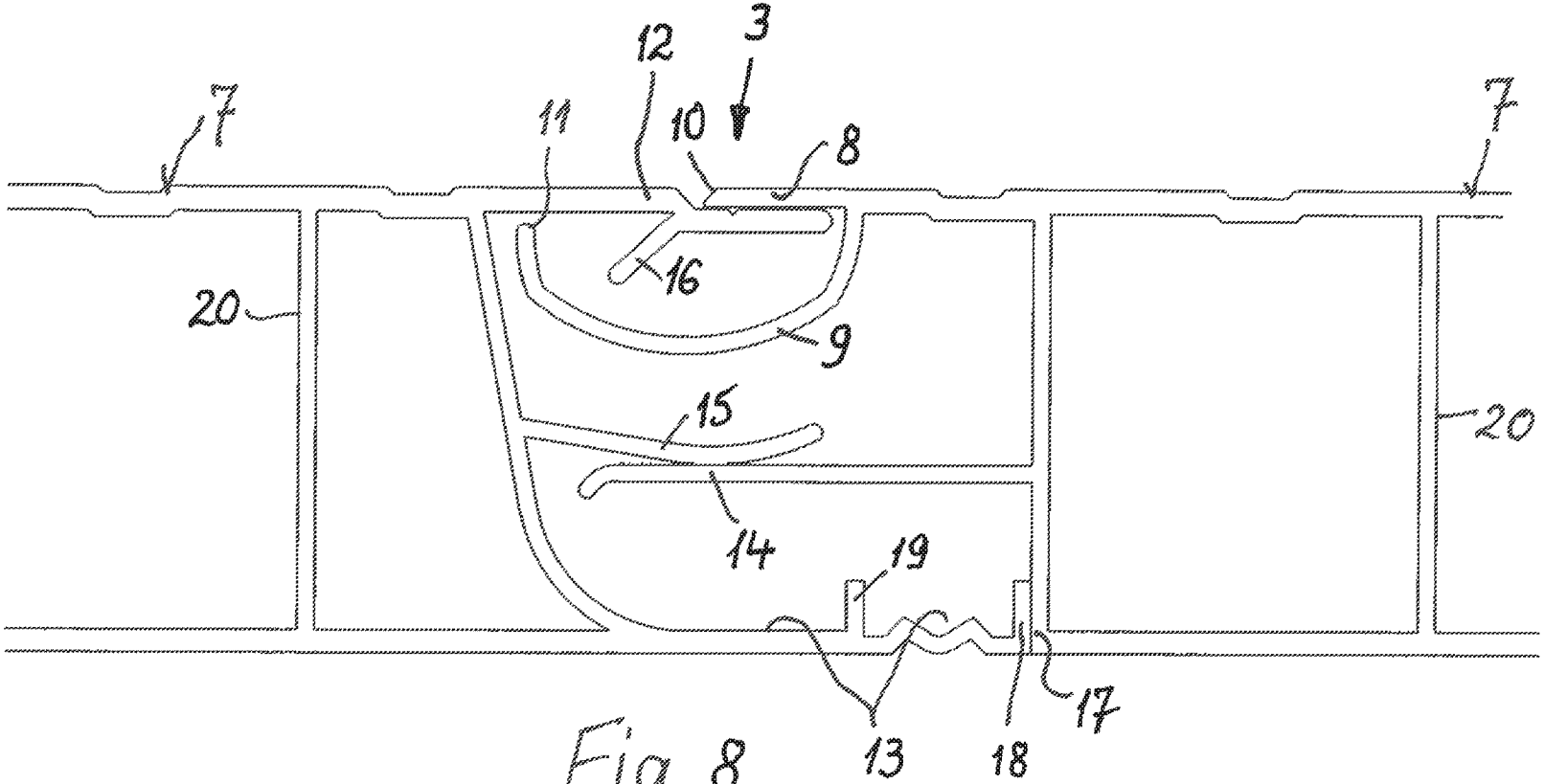
Figure 9:
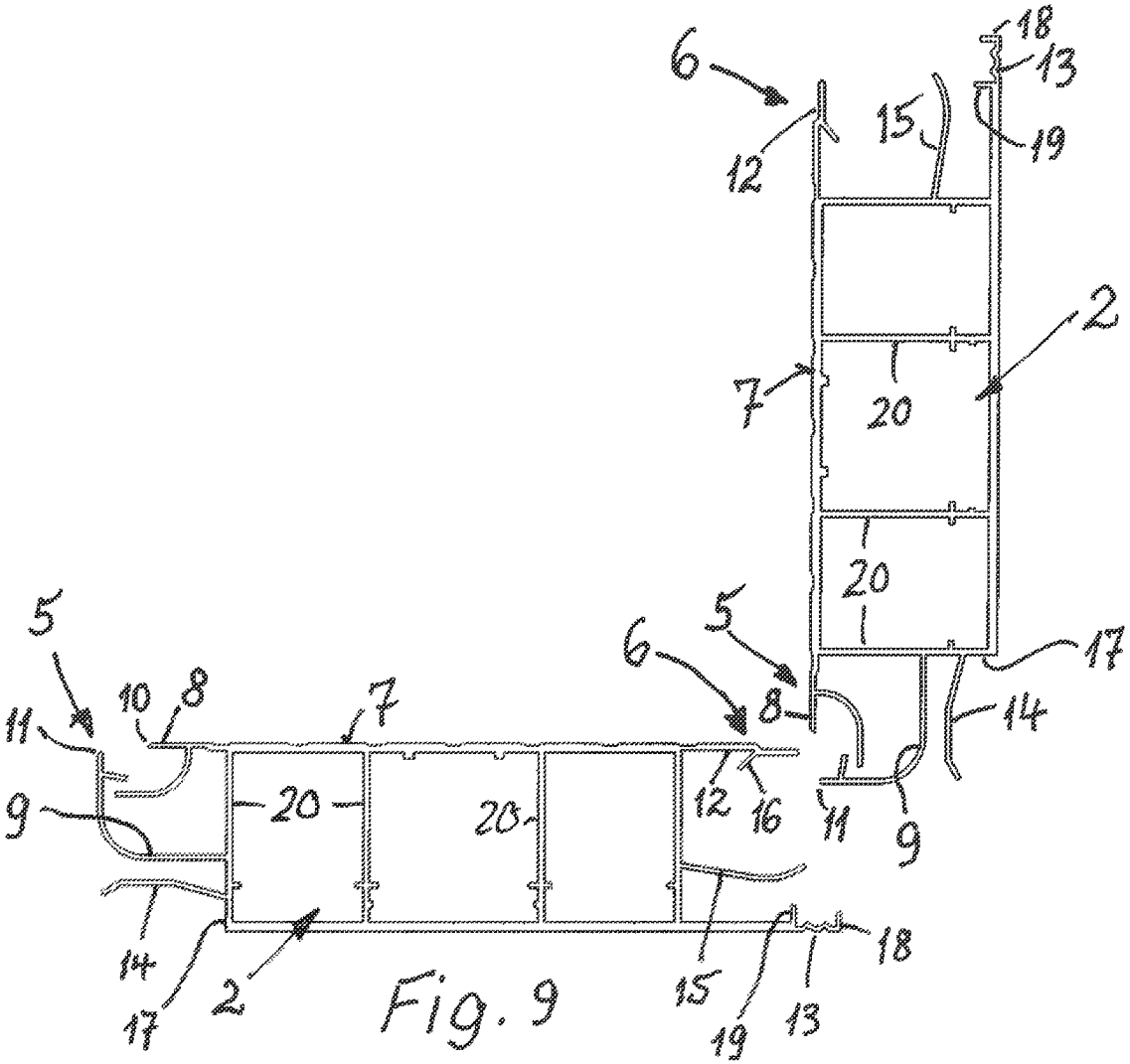
Figure 10:
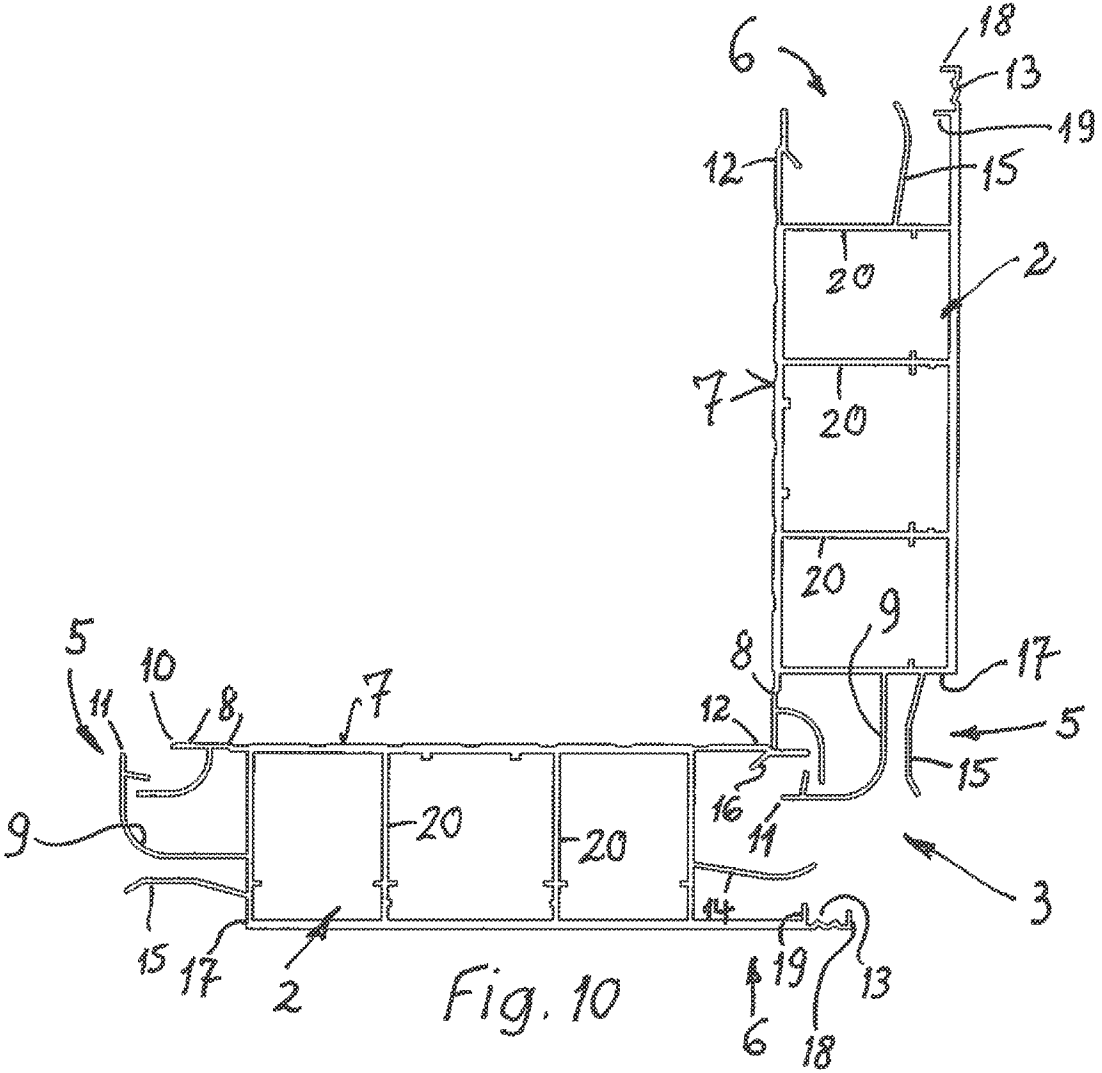

It should also be mentioned that the cross-sectional lengths of webs 8 and 12 and the second collecting gutter 13 are to be of such a size that, when the touching covering plates 2 according to FIGS. 8 and 16 are in the pushed-together position, the bottom side of the cover apparatus 1 is also closed.

Using FIG. 2 to FIG. 16, it can clearly be seen that the cover plates 2 continuing in a position of use exhibit, between their upper and lower delimitation planes in cross-section, at right angles to the same, reinforcement webs 20, wherein the delimitation planes are formed somewhat plate-shaped and the reinforcement webs 20 are of such a size that between the edges 5 and 6 touching and facing away from each other in a position of use of the cover plates 2 and between their side edges at right angles to the edges 5 and 6 facing away from each other are reinforced and mutually-supporting or even self-supporting. Therefore, for example, the roof of the balcony 4 in FIG. 1 can only be formed by the cover plates 2 which are only supported next to the wall of the building on two supports that are not part of the wall. In general, the entire roof may be self-supporting in practice. Also, the balcony surface may be sufficiently stable using cover plates 2 thus formed and corresponding cross-sections of the webs and surfaces forming them, to be loaded and/or be walked on by people.

It should also be mentioned that the upper gutter 9 located in the upper edge region of a respective cover plate 2 overlaps the web 8 also located there, ending free and particularly in a straight line, as a continuation of the top side 7 to an extent which corresponds in the illustrative example to approximately half of the cross-sectional length of the upper free web 8. In so doing, the rain gutter 9 is preferably connected as a single piece somewhat in the centre of this upper web 8.

The reinforcement webs 20 arranged between an upper and a lower plane or layer of the respective cover plate 2 run parallel to the edges 5 and 6 touching when in a position of use and overlap in regions, so that the cover plates 2—for example, made of aluminium or an aluminium alloy and/or of polymer—can be particularly extrusion-pressed.

All in all, the cover plates 2 are formed rectangularly, and their four delimitations therefore form a rectangle, wherein the edges 5 and 6 overlapping in a rainproof manner in a position of use are the longer edges, therefore the longitudinal edges of such a rectangle. Therefore, the length of the longitudinal edges may be a few or many times the length of the transverse edges arranged at a right angle to the same, to be able to provide a corresponding, longitudinally-extended balcony with a roof in which the individual cover plates 2 run over the entire dimension of the roof and in this direction may therefore be uninterrupted, in parallel with a wall of the building.

The cover apparatus 1 with cover plates 2 continuing in a position of use in a common plane in at least one row is formed by overlapping in a mutual edge-side contact region 3 and is therefore rainproof, that spaced-apart edges 5 and 6 running parallel to each other on a respective cover plate 2 are formed differently and on a first edge 5 a web 8 continuing the top side 7 of the cover plate 2, and under this web 8 a rain gutter 9 forming part of the same first edge 5 or the edge 6 of the adjacent cover plate 2 are arranged. Any rainwater penetrating through the overlapping, edge-side webs 8 and 12 in a position of use may therefore be collected in the rain gutter 9 underneath.

The invention claimed is:

1. A cover apparatus (1) with joinable first and second cover plates (2) disposable in a common plane and at least in one row, wherein each of the first and second cover plates having spaced apart first and second edges (5, 6) running parallel to each other which are formed differently with, on the first edge (5), a web (8) which continues from a top side (7) of the cover plate (2) to define a free edge (10) and a rain gutter (9) arranged under the web (8), the rain gutter being connected with the web (8) at a location set back from the free edge (10) of the web (8) with the rain gutter (9) extending to define a rain gutter free edge (11), a first clipping web (14) located on the first edge (5) with the rain gutter (9) being located between the web (8) and the first clipping web (14), and, on the second edge (6), a second web (12) which continues from the top side (7), a second clipping web (15) located on the second edge (6) spaced from the second web (12), wherein, the rain gutter free edge (11) of the first cover plate is configured to loop under the second web (12) of the second cover plate with the first and second cover plates being joined, wherein, an internal gap between the web (8) and the first clipping web (14), of the first cover plate, is less than an external gap between the second web (12) and the second clipping web (15), of the second cover plate, and, wherein, the first and second clipping webs (14, 15) being configured to overlap and be in contact so as to clip with the first and second cover plates being joined.

2. A cover apparatus according to claim 1, wherein, with the first and second cover plates being joined, the web of the first cover plate overlaps the second web of the second cover plate.

3. A cover apparatus according to claim 1, wherein, for each of the first and second cover plates, on the second edge (6), a second collecting gutter (13) for rainwater is provided, which runs parallel to the rain gutter (9).

4. A cover apparatus according to claim 3, wherein, for each of the first and second cover plates, an upstanding web (19) is positioned along the second collecting gutter (13).

5. A cover apparatus according to claim 1, wherein, for the first cover plate, a third gap is defined between the free edge (10) of the web (8) and the rain gutter free edge (11) of the rain gutter (9), the third gap being of such a size that, the second web (12) of the second cover plate is able to be inserted at least inclined into the third gap and pivoted to join the first and second cover plates.

6. A cover apparatus according to claim 1, wherein at least one of the first and second clipping webs (14 or 15) has a bent cross-section.

7. A cover apparatus according to claim 6, wherein the first clipping web of the first cover plate and the second clipping web of the second cover plate each has a bent cross-section such that the bends of the first and second clipping webs are generally in opposing directions.

8. A cover apparatus according to claim 1, wherein, in joining the first and second cover plates, the first clipping web (14) of the first cover plate and the second clipping web (15) of the second cover plate are able to be pushed together, with the extent of pushing being delimited by at least one stop.

9. A cover apparatus according to claim 8, wherein the at least one stop is defined by a first portion of the first cover plate and a second portion of the second cover plate (2), the first and second portions being flush with the first and second cover plates being joined.

10. A cover apparatus according to claim 9, wherein, on the second edge (6) of the second cover plate, a second collecting gutter (13) for rainwater is provided, the second portion of the second cover plate being defined on the second collecting gutter (13).

11. A cover apparatus according to claim 1, wherein, for each of the first and second cover plates, reinforcement webs (20) extend from the top side (7).

12. A cover apparatus according to claim 11, wherein, for each of the first and second cover plates, the reinforcement webs (20) run parallel to the first and second edges (5, 6).

13. A cover apparatus according to claim 1, wherein, for each of the first and second plates, the gutter (9) protrudes beyond the free edge (10) of the web (8).

14. A cover apparatus according to claim 1, wherein the first and second cover plates (2) are made of aluminium.

15. A cover apparatus according to claim 1, wherein the first and second cover plates (2) are made of aluminium alloy.

16. A cover apparatus according to claim 1, wherein the first and second cover plates (2) are made of polymer.

* * * * *